US010016880B2

(12) United States Patent
Chung

(10) Patent No.: US 10,016,880 B2
(45) Date of Patent: Jul. 10, 2018

(54) SELECTIVELY ONE-WAY WRENCH

(71) Applicant: Hui-Hsueh Chung, Taichung (TW)

(72) Inventor: Hui-Hsueh Chung, Taichung (TW)

( * ) Notice: Subject to any disclaimer, the term of this patent is extended or adjusted under 35 U.S.C. 154(b) by 18 days.

(21) Appl. No.: 15/289,823

(22) Filed: Oct. 10, 2016

(65) Prior Publication Data

US 2018/0099385 A1 Apr. 12, 2018

(51) Int. Cl.
*B25B 13/46* (2006.01)
*B25B 15/04* (2006.01)

(52) U.S. Cl.
CPC ..... *B25B 13/463* (2013.01); *B25B 13/465* (2013.01); *B25B 13/468* (2013.01); *B25B 15/04* (2013.01)

(58) Field of Classification Search
CPC ..... B25B 13/463; B25B 15/04; B25B 13/465; B25B 13/468; B25B 13/461
See application file for complete search history.

(56) References Cited

U.S. PATENT DOCUMENTS 581,427 A * 4/1897 Olson ..... B25B 13/467 192/43.1
5,178,047 A * 1/1993 Arnold ..... B25B 13/463 81/60
5,927,158 A * 7/1999 Lin ..... B25B 13/12 81/60
7,121,169 B1 * 10/2006 Larson ..... B25B 13/463 81/58.1
7,299,720 B1 * 11/2007 Schultz ..... B25B 13/463 81/62
2004/0261584 A1 * 12/2004 Huang ..... B25B 13/463 81/63.1
2005/0011315 A1 * 1/2005 Chen ..... B25B 13/463 81/63.1
2006/0101952 A1 * 5/2006 Lee ..... B25B 13/463 81/63.2
2008/0229887 A1 * 9/2008 Thompson ..... B25B 13/463 81/62
2008/0229889 A1 * 9/2008 Hopper ..... B25B 13/463 81/63.1
2008/0245194 A1 * 10/2008 Ross ..... B25B 13/463 81/63.1
2011/0308359 A1 * 12/2011 Hu ..... B25B 13/463 81/63.2

* cited by examiner

*Primary Examiner* — Monica Carter
*Assistant Examiner* — Danny Hong

(57) ABSTRACT

A switch assembly for a selectively one-way wrench includes a disc and a pusher. The disc includes two hooks, a cutout between the hooks, and an axle extending from the disc. The axle includes first and second faces, an arched face extending between the first and second faces, and an apex formed between the first and second faces. The pusher extends around the axle and includes two arched portions, two flat portions formed between the arched portions, a middle portion formed between the flat portions, and a gap between free ends of the arched portions. The arched portions extend around the arched face.

5 Claims, 8 Drawing Sheets

SELECTIVELY ONE-WAY WRENCH

BACKGROUND OF INVENTION

1. Field of Invention

The present invention relates to a selectively one-way wrench and, more particularly, to a switch assembly for a selectively one-way wrench.

2. Related Prior Art

Taiwanese Patent 1546162 discloses a selectively one-way wrench that includes a body 10, a toothed wheel 20, a single pawl 30 and a control unit 40. The body 10 contains the toothed wheel 20, the pawl 30 and the control unit 40. The toothed wheel 20 includes teeth 21 on the periphery. The pawl 30 includes, on a side, teeth 31 for engagement with the teeth 21 of the toothed wheel 20 and, in another side, a cavity 33. The control unit 40 includes a switch 41, a pusher 42 inserted in the switch 41, and a spring 43 for biasing the pusher 42. The pusher 42 includes a rounded end inserted in the cavity 33 and a recessed end for receiving an end of the spring 43. The switch 41 is switchable between two positions. As the switch 41 is in a selected one of the positions, a selected one of two portions of the pawl 30 are allowed to engage with the toothed wheel 20. Thus, the body 10 causes the pawl 30 to drive the toothed wheel 20 in a selected one of two senses of direction, but not in the other sense. However, the engagement of only the selected portion of the pawl 30 with the toothed wheel 20 is inadequate so that the pawl 30 would rattle on the toothed wheel 20. Hence, normal operation of the selectively one-way wrench could be jeopardized. Moreover, the pawl 30 and the toothed wheel 20 would wear away each other.

U.S. Pat. No. 9,038,507 discloses another selectively one-way wrench that includes a head 10, two pawls 20 and 22, a ratchet gear 24 and a control unit. The head 10 contains the pawls 20 and 22, the ratchet gear 24 and the control unit. A spring 107 is compressed between the pawls 20 and 22. Each of the pawls 20 and 22 is formed with a selector post 100. The control unit includes a lever 70 and a disc 90. The lever 70 includes a post 92 inserted in a bore 94 made in the disc 90. The disc 90 includes a cutout 102 made between two hooks 106 formed thereon. The lever 70 is switchable between two positions. As the lever 70 is in a selected one of the positions, a selected one of the pawls 20 and 22 is allowed to engage with the ratchet gear 24. Thus, the head 10 rotates the ratchet gear 24 via the selected pawl 20 or 22 in a selected one of two senses of direction, but not in the other sense of direction. However, the spring 107 biases the selected pawl 20 or 22 in a direction that is not coincide with or parallel to a direction in which the selected pawl 20 or 22 is pressed against on the ratchet gear 24. Thus, the engagement of the selected pawl 20 or 22 with the ratchet gear 24 is inadequate so that the selected pawl 20 or 22 would rattle on the ratchet gear 24. Hence, normal operation of the selectively one-way wrench could be jeopardized. Moreover, the selected pawl 20 or 22 and the ratchet gear 24 would wear away each other.

The present invention is therefore intended to obviate or at least alleviate the problems encountered in prior art.

SUMMARY OF INVENTION

It is the primary objective of the present invention to provide a reliable selectively one-way wrench.

To achieve the foregoing objective, the selectively one-way wrench includes a head, a rotor, a pawl assembly and a switch assembly. The rotor includes a toothed wheel rotationally inserted in the head. The pawl assembly includes first and second pawls both inserted in the head. Each of the first and second pawls includes a rod and a toothed face for engagement with the toothed wheel to allow the head to rotate the rotor in a selected one of two opposite senses of direction but not in the other sense. The switch assembly includes a switch, a disc and a pusher. The disc is inserted in the head, and includes two hooks, an arched cutout between the hooks, and an axle on a face thereof. The disc and the axle are rotatable relative to the head. The disc cooperates with the head to keep the axle in position. The pusher extends around the axle and includes two flat portions. The switch is connected to the axle, located out of the head, and operable to rotate the disc and the axle. When the rod of the first pawl is hooked by a corresponding one of the hooks, the first pawl cooperates with the axle to clamp a corresponding one of the flat portions and cause the other flat portion to abut against the second pawl to keep the toothed face of the second pawl in proper engagement with the toothed wheel. When the rod of the second pawl is hooked by a corresponding one of the hooks, the second pawl cooperates with the axle to clamp a corresponding one of the flat portions and cause the other flat portion to abut against the first pawl to keep the toothed face of the first pawl in proper engagement with the toothed wheel.

Other objectives, advantages and features of the present invention will be apparent from the following description referring to the attached drawings.

BRIEF DESCRIPTION OF DRAWINGS

The present invention will be described via detailed illustration of the preferred embodiment referring to the drawings wherein.

DETAILED DESCRIPTION OF PREFERRED EMBODIMENT

Figure 1:
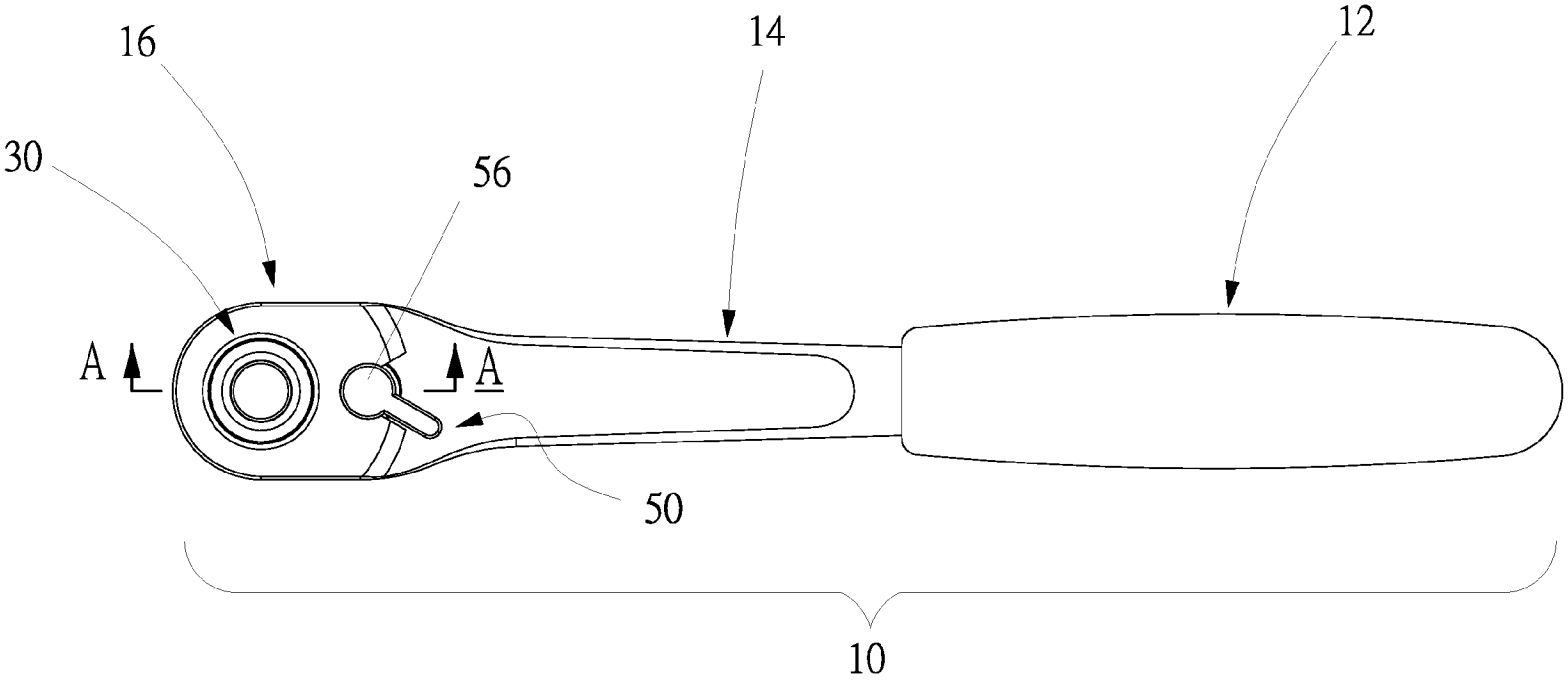
FIG. 1 is a top view of a selectively one-way wrench according to the preferred embodiment of the present invention.
Figure 2:
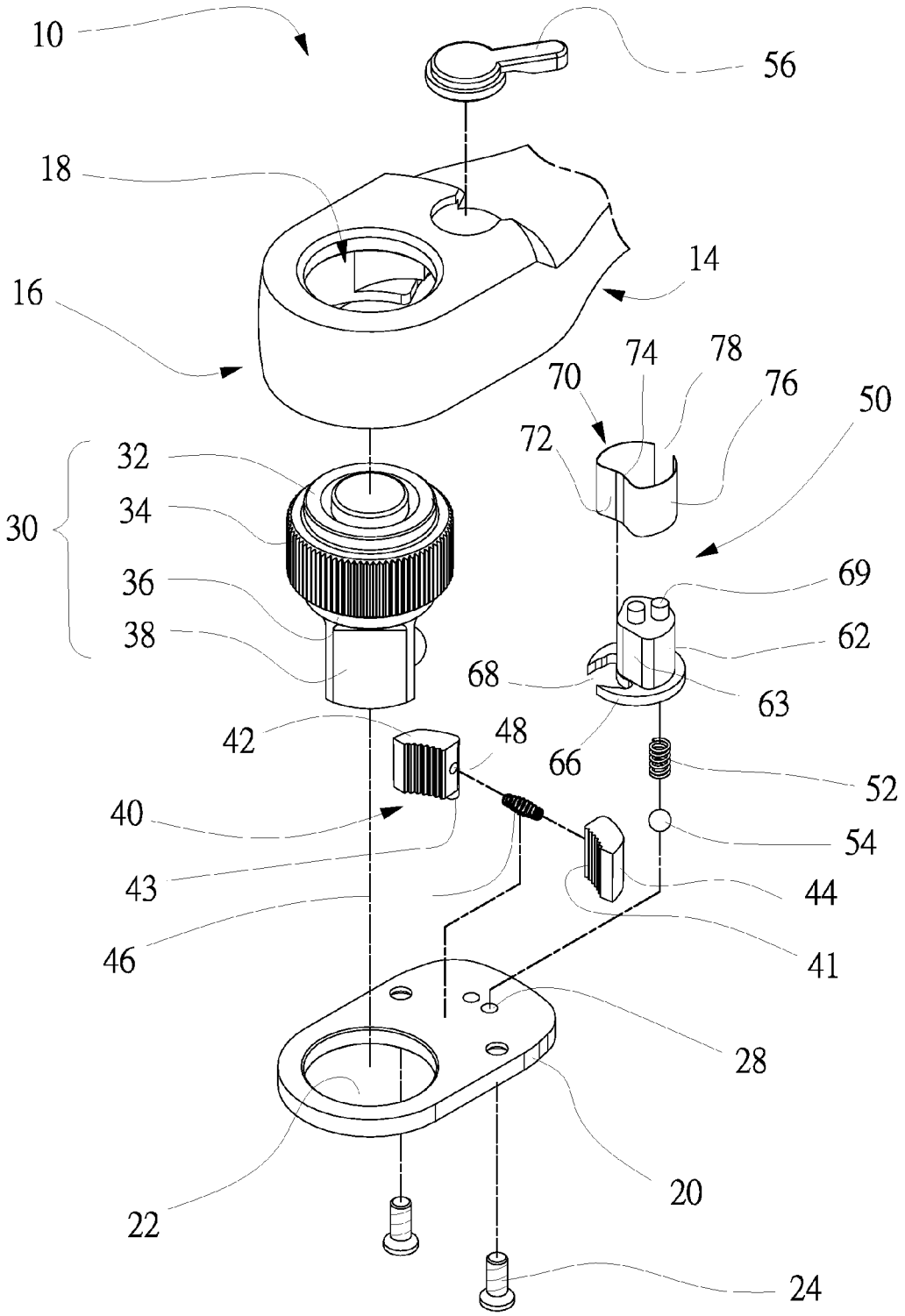
FIG. 2 is an exploded view of the selectively one-way wrench shown in FIG. 1.
Figure 3:
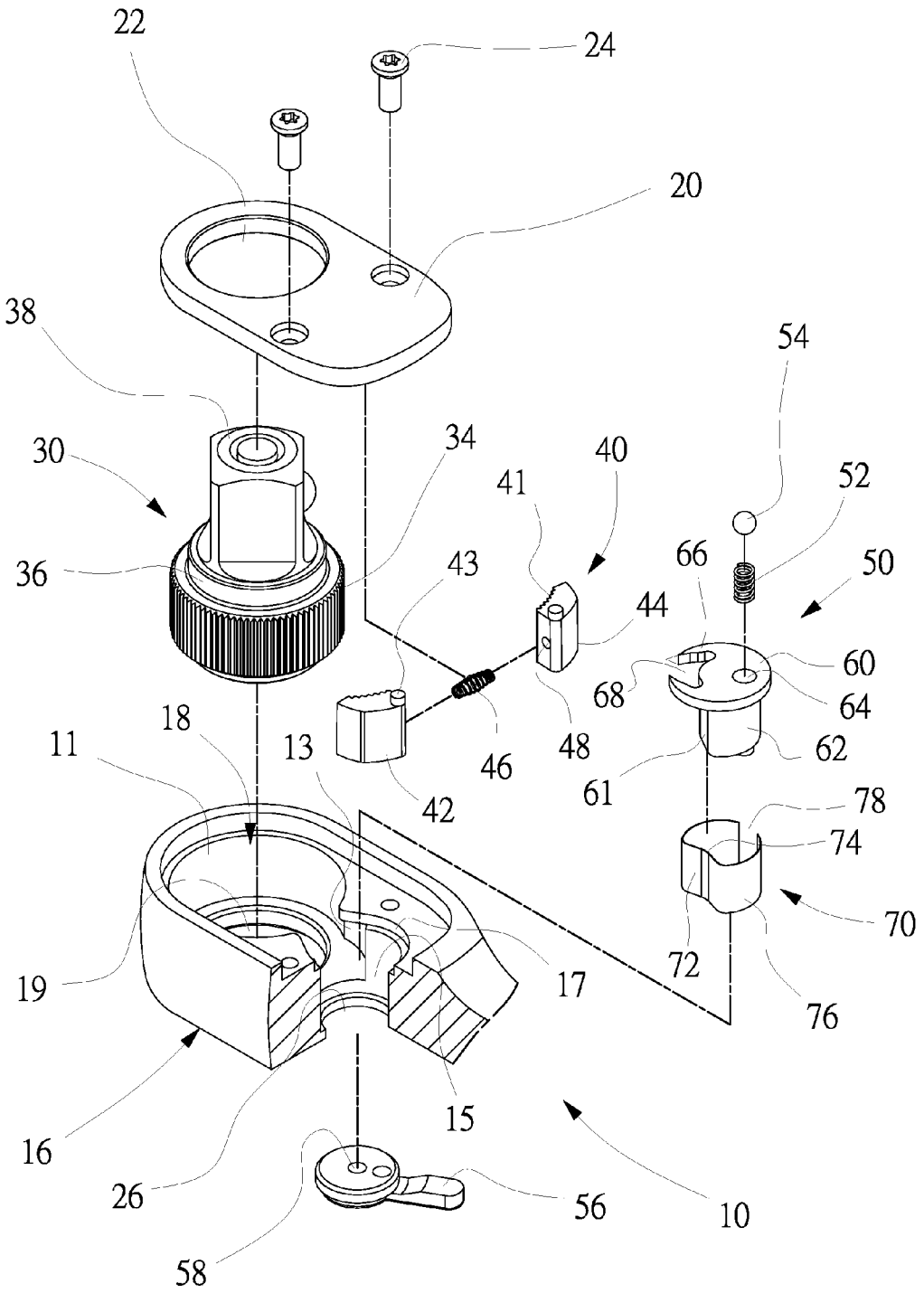
FIG. 3 is another exploded view of the selectively one-way wrench shown in FIG. 2.
Figure 4:
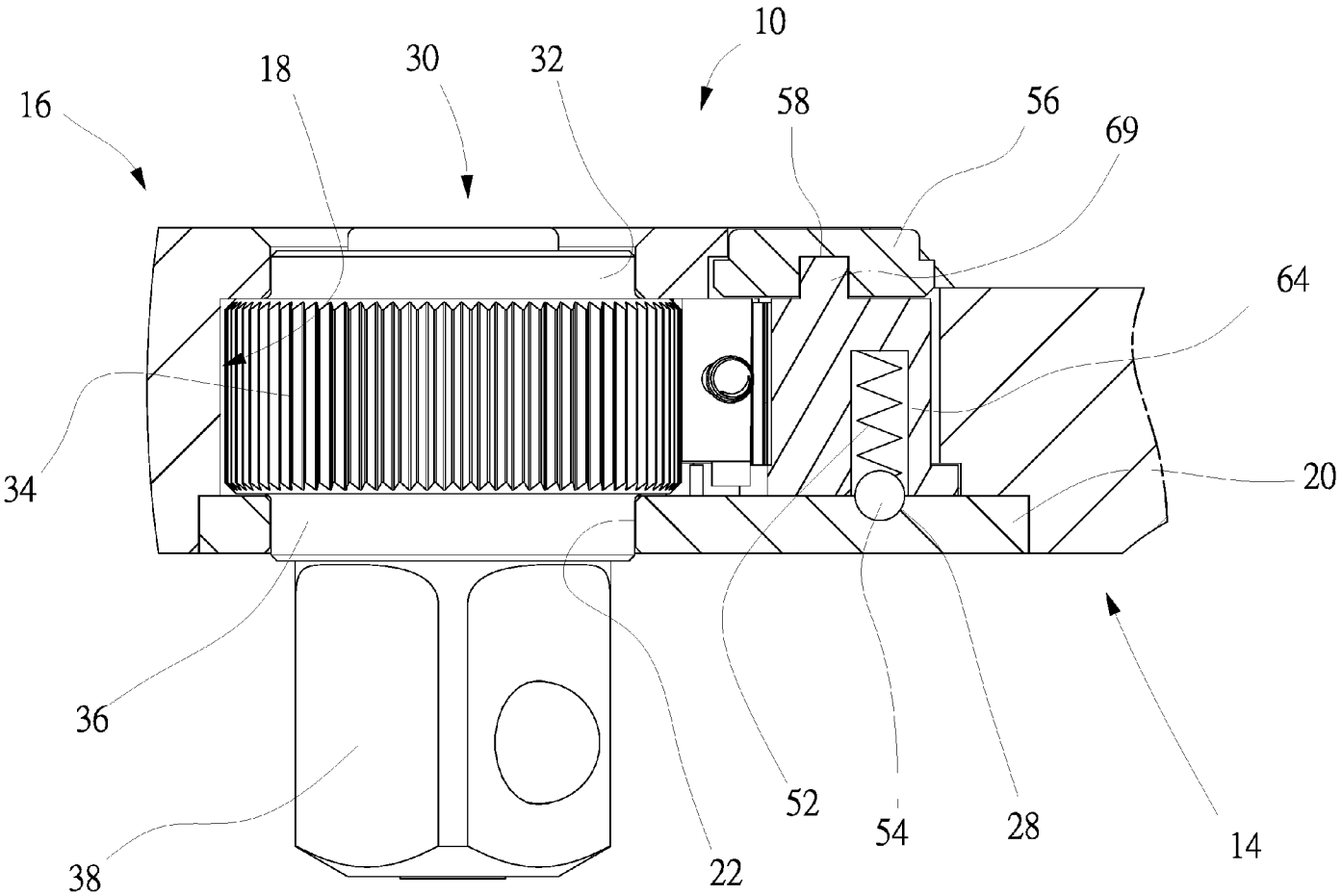
FIG. 4 is a cross-sectional view of the selectively one-way wrench shown in FIG. 1.

Referring to FIGS. 1 through 4, a selectively one-way wrench 10 includes a grip 12, shank 14, a head 16, a cover 20, a rotor 30, a pawl assembly 40 and a switch assembly 50 according to the preferred embodiment of the present invention. The grip 12, the shank 14 and the head 16 are in one piece. The grip 12 is formed at an end of the shank 14. The head 16 is provided on the shank 14 near another. Thus, the grip 12 is operable to pivot the head 16. However, in another embodiment, the selectively one-way wrench 10 includes only the head 16, without using any grip or shank. Details for such an embodiment can be found in U.S. Pat. No. 9,038,507.

The head 16 includes a shell 18 and a cover 20. The shell 18 includes three chambers 11, 13 and 15 and three openings 17, 19 and 26. The chamber 11 is substantially a circular space. The chamber 13 is substantially a crescent space in communication with the chamber 11. The chamber 15 is substantially a circular space in communication with the chamber 13. The opening 17 is substantially a circular opening located below the space 15. The opening 17 is in communication with all of the chambers 11, 13 and 15. The opening 26 is substantially a circular opening located above and in communication with the space 15. The opening 19 is substantially a circular opening located above and in communication with the space 11. In another embodiment, the opening 19 can be in another form as shown in U.S. Pat. No. 9,038,507 for example.

The cover 20 includes an opening 22 corresponding to the opening 19 and two cavities 28 corresponding to the chambers 15 and 17. The cover 20 is secured to the shell 18 by two screws 24 for example after the rotor 30, the pawl assembly 40 and the switch assembly 50 are inserted in the shell 18.

The rotor 30 includes, sequentially, an upper axle 32, a toothed wheel 34, a lower axle 36 and an insert 38. The toothed wheel 34 is rotationally inserted in the chamber 11. The upper axle 32 is inserted in the opening 19 and the lower axle 36 extends throughout the opening 22 to ensure smooth rotation of the toothed wheel 34 in the chamber 11. Hence, the insert 38 is rotatable with the toothed wheel 34.

The pawl assembly 40 is inserted in the chamber 13. The pawl assembly 40 can be selectively engaged with or disengaged from the toothed wheel 34 to allow the head 16 to rotate the rotor 30 via the pawl assembly 40 in a selected one of two senses of direction.

The pawl assembly 40 includes two pawls 42 and 44 and a spring 46. Each of the pawls 42 and 44 includes a toothed face 41 corresponding to the toothed wheel 34, a rod 43 extending from an upper face, and a bore 48 corresponding to the spring 46. The spring 46 is preferably a helical spring formed with two ends each inserted in the bore 48 of a corresponding one of the pawls 42 and 44. The spring 46 tends to push the pawls 42 and 44 away from each other.

In detail, the pawl 42 is operable to engage with the toothed wheel 34. Thus, the head 16 can drive the rotor 30 and a work-piece in a first sense of direction. However, the head 16 cannot drive the rotor 30 in a second sense of direction opposite to the first sense of direction because the pawl 42 is allowed to rattle on the toothed wheel 34.

Alternatively, the pawl 44 is operable to engage with the toothed wheel 34. Thus, the head 16 can drive the rotor 30 in the second sense of direction. However, the head 16 cannot drive the rotor 30 in the first sense of direction opposite to the first sense of direction because the pawl 44 is allowed to rattle on the toothed wheel 34.

The switch assembly 50 includes a spring 52, a ball 54, a switch 56, a disc 60 and a pusher 70. The disc 60 includes an arched cutout 68 at the edge thereof, thereby forming two hooks 66 between which the arched cutout 68 is located. A bore 64 is made in a face of the disc 60. An axle 62 extends from another face of the disc 60. At least one stem 69 extends from the axle 62.

The bore 64 receives the spring 52 and the ball 54. Now, an end of the spring 52 is placed against a closed end of the bore 64. Another end of the ball 54 is placed out of the bore 64 through an open end of the bore 64.

Preferably, there are two circular stems 69 inserted in two circular bores 58 made in the switch 56 to render the axle 62 rotatable with the disc 60. However, in another embodiment, there can be only one non-circular stem 69 fitted in only one non-circular bore 58 made in the switch 56.

Figure 6:
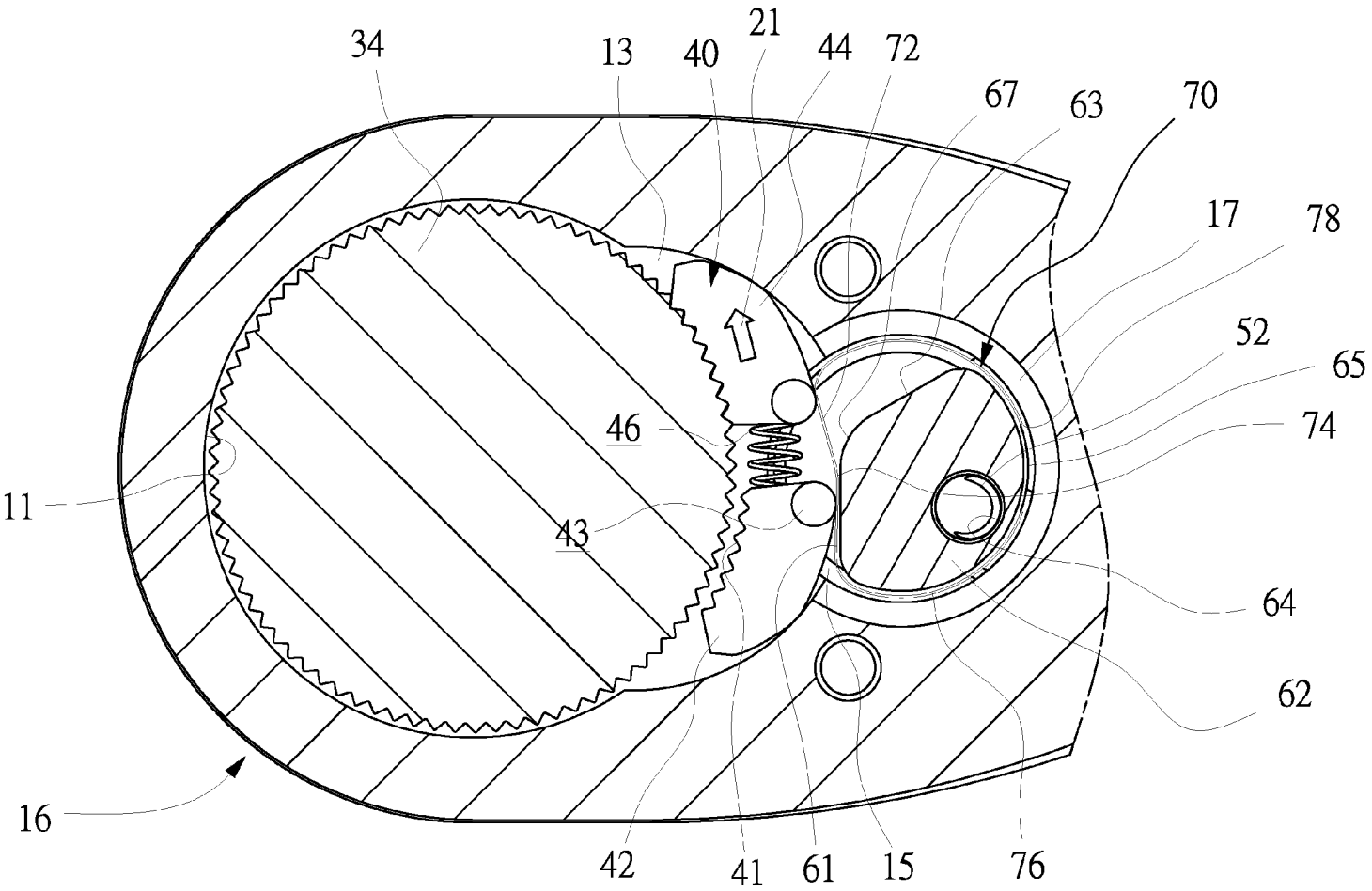
FIG. 6 is another cross-sectional view of the selectively one-way wrench shown in FIG. 5.
Figure 8:
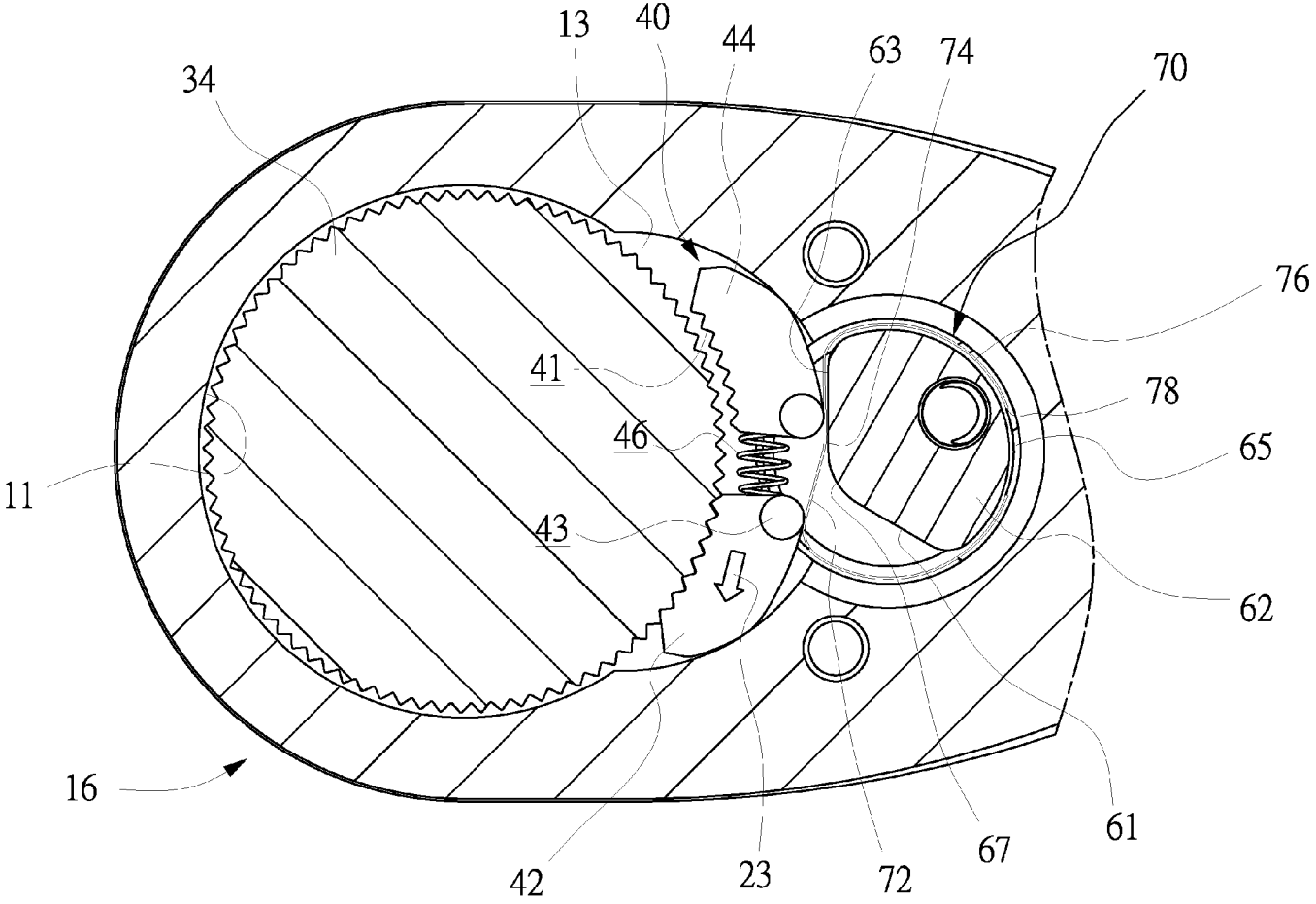
FIG. 8 is another cross-sectional view of the selectively one-way wrench shown in FIG. 7.

Referring to FIGS. 6 and 8, the axle 62 is formed with two flat faces 61 and 63, an arched face 65 and an apex 67. The arched face 65 extends between two flat faces 61 and 63. The apex 67 is formed between the flat faces 61 and 63.

When the axle 62 extends through the chamber 15, the disc 60 is supported on a shoulder (not numbered) formed between the chamber 15 and the opening 17. Thus, a portion of the axle 62 is located out of the head 16 and connected to the switch 56 to facilitate a user to operate the switch 56 to rotate the axle 62 relative to the head 16. Now, the ball 54 is kept in one of the cavities 28, thereby keeping the disc 60 and the axle 62 in a selected one of two positions.

The pusher 70 is essentially a leaf spring that includes a middle portion 74, two flat portions 72 and two arched portions 76. Each of the flat portions 72 extends from a corresponding end of the middle portion 74 at an angle. Each of the arched portions 76 extends from a corresponding one of the flat portions 72 so that each of the arched portions 76 includes a free end. The free ends of the arched portions 76 are separated from each other by a gap 78. Referring to FIGS. 5-8, the pusher 70 is inserted in the chamber 15. The pusher 70 extends around the axle 62.

Figure 5:
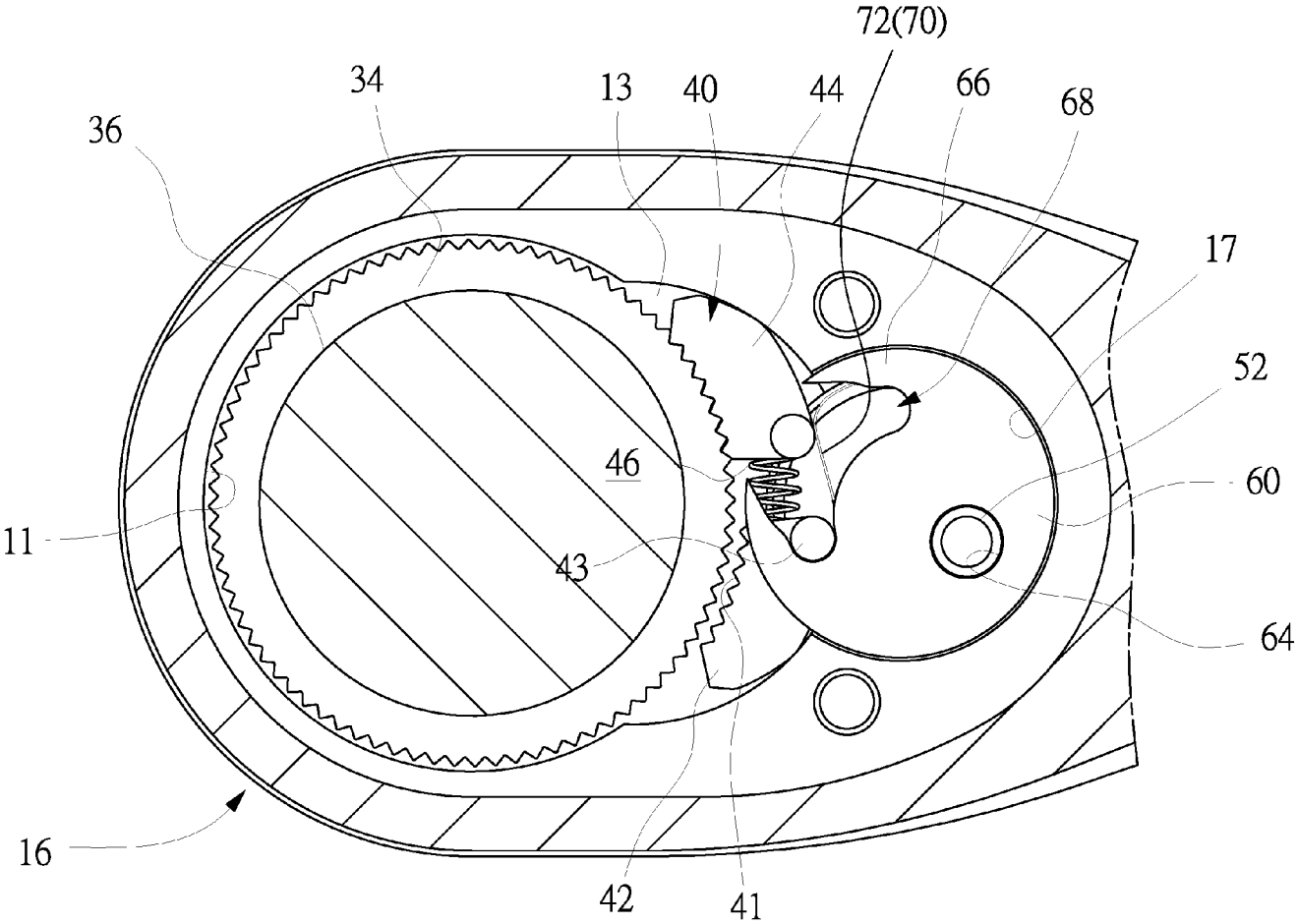
FIG. 5 is another cross-sectional view of the selectively one-way wrench shown in FIG. 4.

Referring to FIGS. 5 and 6, the axle 62 is in one of the positions to cause one of the flat portions 72 (the "first flat portion 72") of the pusher 70 to abut against the pawl 42 to keep the pawl 42 in proper engagement with the toothed wheel 34. Hence, torque can be effectively transmitted to the insert 38 from the head 16.

One of the hooks 66 hooks the rod 43 of the pawl 44 so that the rod 43 of the pawl 44 is located near the middle portion 74 of the pusher 70. Moreover, the toothed face 41 of the pawl 44 is disengaged from the toothed wheel 34 while an opposite face of the pawl 44 is in contact with the wall of the chamber 13 and the other flat portion 72 (the "second flat portion 72"). The spring 46 biases the pawl 42 in a sense of direction as indicated by an arrow head 21. Thus, the toothed face 41 of the pawl 42 is engaged with the toothed wheel 34 while an opposite face of the pawl 42 is in contact with the wall of the chamber 13 and the first flat portion 72.

The flat face 63 is away from the pawl 42. The flat face 61 and the pawl 44 clamp the second flat portion 72 to cause the first flat portion 72 to abut against the pawl 42. The first flat portion 72 abuts against the pawl 42 in a direction substantially coincide with a radius of the rotor 30. Hence, the pawl 42 is in proper engagement with the toothed wheel 34.

Figure 7:
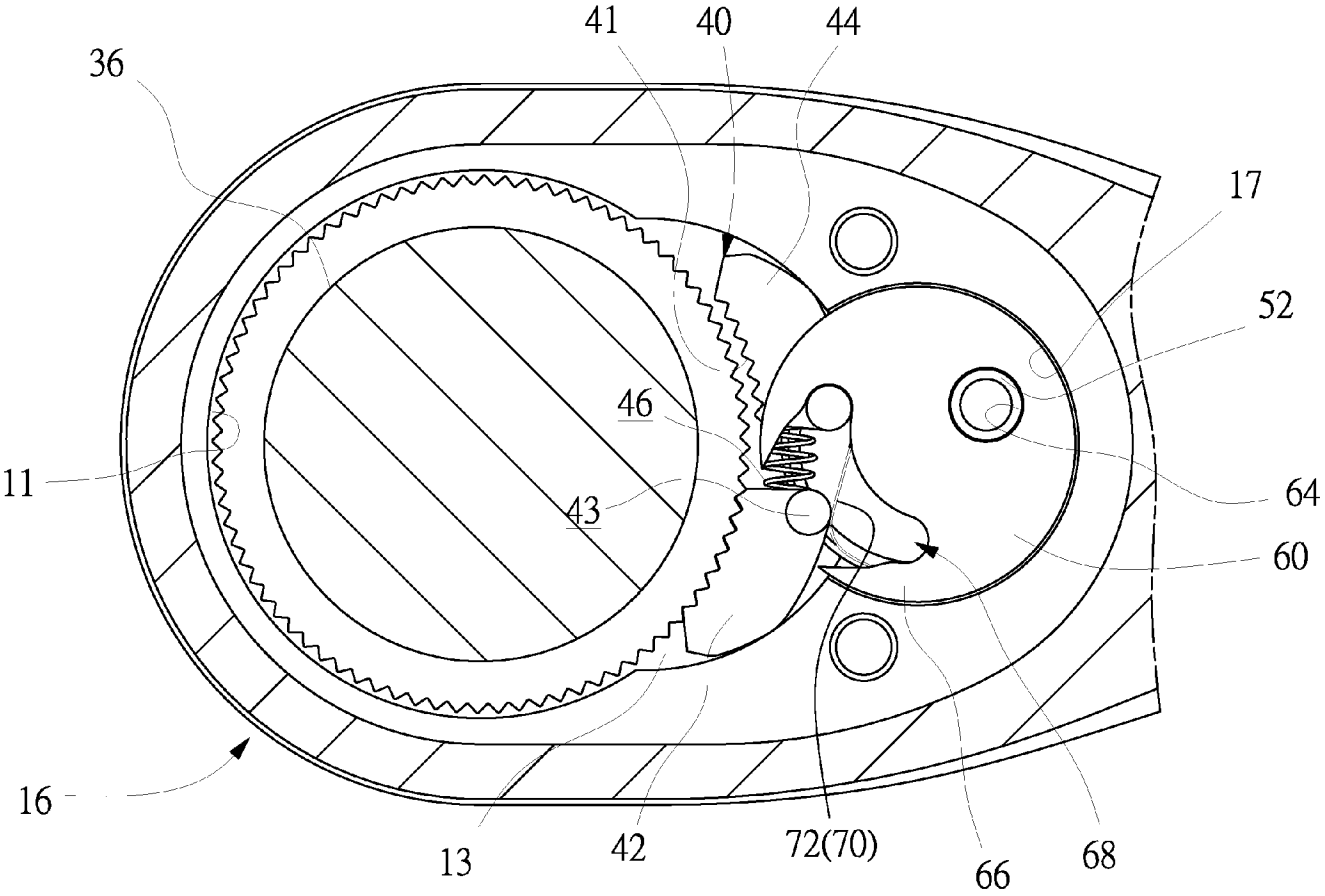
FIG. 7 is a cross-sectional view of the selectively one-way wrench in another position than shown in FIG. 5.

The switch 56 is operable to move the disc 60 and the axle 62 into the position shown in FIGS. 7 and 8 from the position shown in FIGS. 5 and 6. During the movement, as the apex 67 of the axle 62 is brought into contact with the middle portion 74, the angle between the flat portions 72 is increased, and the arched portions 76 open along the arched face 65. After the apex 67 of the axle 62 is moved past the middle portion 74, the angle of the flat portions 72 is reduced, and the arched portions 76 close along the arched face 65. The width of the gap 78 is smaller than the diameter of the axle 62 so that the pusher 70 cannot be removed from the axle 62 in a radial manner and that the rotation of the disc 60 and the axle 62 relative to the head 16 is not affected.

Referring to FIGS. 7 and 8, the axle 62 is in the other position to make the second flat portion 72 of the pusher 70 abut against the pawl 44 to keep the pawl 44 in proper engagement with the toothed wheel 34. Thus, torque can be effectively transmitted to the insert 38 from the head 16.

The other hook 66 hooks the rod 43 of the pawl 42 so that the rod 43 of the pawl 42 is located near the middle portion 74 of the pusher 70. Moreover, the toothed face 41 of the pawl 42 is disengaged from the toothed wheel 34 while an opposite face of the pawl 42 is in contact with the wall of the chamber 13 and the first flat portion 72. The spring 46 biases the pawl 44 in a sense of direction as indicated by an arrow head 23. Thus, the toothed face 41 of the pawl 44 is engaged with the toothed wheel 34 while an opposite face of the pawl 44 is in contact with the wall of the chamber 13 and the second flat portion 72.

The flat face 61 is away from the pawl 44. The flat face 63 and the pawl 42 clamp the first flat portion 72 to cause the second flat portion 72 to abut against the pawl 44. The second flat portion 72 abuts against the pawl 44 in a direction substantially coincide with another radius of the rotor 30. Hence, the pawl 44 is in proper engagement with the toothed wheel 34.

The present invention has been described via the illustration of the preferred embodiment. Those skilled in the art can derive variations from the preferred embodiment without departing from the scope of the present invention. Therefore, the preferred embodiment shall not limit the scope of the present invention defined in the claims.

The invention claimed is:

1. A selectively one-way wrench comprising:

a head;

a rotor comprising a toothed wheel rotationally inserted in the head;

a pawl assembly comprising first and second pawls both inserted in the head, wherein each of the first and second pawls comprises a rod and a toothed face for engagement with the toothed wheel to allow the head to rotate the rotor in a selected one of two opposite senses of direction but not in the other sense; and a switch assembly and comprising:

a disc inserted in the head and formed with two hooks, an arched cutout between the hooks, and an axle on a face thereof, wherein the disc is rotatable relative to and co-operable with the head to keep the axle in position;

a pusher extending around the axle and comprising two flat portions; and a switch connected to the axle, located out of the head, and operable to rotate the disc and the axle;

wherein when the rod of the first pawl is hooked by a corresponding one of the hooks, the first pawl and the axle together clamp a corresponding one of the flat portions and cause the other flat portion to abut against the second pawl to keep the toothed face of the second pawl in proper engagement with the toothed wheel;

wherein when the rod of the second pawl is hooked by a corresponding one of the hooks, the second pawl and the axle together clamp a corresponding one of the flat portions and cause the other flat portion to abut against the first pawl to keep the toothed face of the first pawl in proper engagement with the toothed wheel.

2. The selectively one-way wrench according to claim 1, wherein the axle comprises first and second flat face, an arched face extending between the first and second flat faces, and an apex formed between the first and second flat faces.

3. The selectively one-way wrench according to claim 2, wherein the pusher comprises two arched portions extending around the arched face, two flat portions formed between the arched portions, and a middle portion formed between the flat portions, wherein the first pawl and the first flat face together clamp the corresponding flat portion when the rod of the first pawl is hooked by the corresponding hook, and the second pawl and the second flat face together clamp the corresponding flat portion when the rod of the second pawl is hooked by the corresponding hook.

4. The selectively one-way wrench according to claim 1, wherein the axle comprises two stems inserted in two bores made in the switch.

5. The selectively one-way wrench according to claim 1, wherein the switch assembly comprises a spring and a ball inserted in a bore made in the axle via the disc, and the spring abuts against a portion of the ball to carry an opposite portion of the ball out of the bore.

* * * * *